United States Patent [19]

Boyce et al.

[11] Patent Number: 4,619,207

[45] Date of Patent: Oct. 28, 1986

[54] PALLET MADE FROM SHEET OF RIGID MATERIAL

[75] Inventors: N. Blake Boyce, Rigby; J. Neil McSpadden, Shelley, both of Id.

[73] Assignee: Universal Plastics, Inc., Salt Lake City, Utah

[21] Appl. No.: 593,686

[22] Filed: Mar. 26, 1984

[51] Int. Cl.[4] ..... B65D 19/38

[52] U.S. Cl. ..... 108/51.1; 108/53.1

[58] Field of Search ..... 108/51.1, 53.1, 53.3, 108/56.3, 901

[56] References Cited

U.S. PATENT DOCUMENTS

| | | | |
|---|---|---|---|
| 3,707,127 | 12/1972 | Palfey | 108/53.3 |
| 4,246,734 | 1/1981 | Fogle, Jr. et al. | 108/901 X |

FOREIGN PATENT DOCUMENTS

| | | | |
|---|---|---|---|
| 2101535 | 9/1972 | Fed. Rep. of Germany | 108/901 |
| 2229243 | 12/1973 | Fed. Rep. of Germany | 108/56.3 |
| 2525478 | 12/1976 | Fed. Rep. of Germany | 108/51.1 |
| 223090 | 9/1967 | Sweden | 108/51.1 |
| 1026434 | 4/1966 | United Kingdom | 108/53.3 |

*Primary Examiner*—Peter A. Aschenbrenner

*Attorney, Agent, or Firm*—Thorpe, North and Western

[57] ABSTRACT

A plastic pallet is disclosed which exhibits superior strength while also being nestable one within another. The increased strength is provided by a recessed receptacle or cavity formed at the central portion of the upper surface of the pallet. A center plug or insert is received within the countersunk receptacle to provide strength for the pallet to resist deflection of the central portion of the pallet when the pallet is supported along peripheral sides thereof.

7 Claims, 9 Drawing Figures

PALLET MADE FROM SHEET OF RIGID MATERIAL

BACKGROUND OF THE INVENTION

1. Field

The invention relates broadly to pallets used in shipping and storage for supporting material loads thereon wherein the loads are readily handled by conventional lift trucks and hand pallet trucks. In particular, the invention relates to pallets molded or formed from a sheet of rigid, formable material such as a plastic or polymeric material, wherein stiffening ribs are formed integrally therewith so as to extend radially outwardly from a well or depression integrally formed in the central portion of the sheet of material, and a removable load distributing insert is adapted to be received within the well or depression.

2. State of the Art

Pallets are used widely in shipping and warehousing operations. Pallets made of wood or wood byproducts have been used extensively. Wooden pallets, although being generally strong mechanically, have numerous drawbacks. Wooden pallets are heavy and cumbersome, and they are subject to wear and tear. Wooden pallets are held together with fasteners such as nails, staples, glue, etc., which may cause numerous problems in material handling. Products stored or shipped on such wooden pallets are oftentimes damaged by nails or other fasteners which withdraw or back out of the wooden members due to handling or weather conditions. The process of making wooden pallets is time consuming and, thus, generally costly. The cost of wooden pallets is further dependent upon the availability of wood or wood products. Furthermore, wooden pallets are susceptible to weathering and splintering which compromises the usefulness of the pallets.

It has been suggested to fabricate one piece, nestable-type pallets from metal, plastic, and fiber materials. Metal pallets are usually heavy and possess sharp edges or burrs on most of their surfaces. The sharp edges or burrs require the use of extreme caution when handling the metal pallets. In addition, the metal pallets are rather expensive to manufacture.

Pallets made of plastic and fiber reinforced materials generally avoid the problems and disadvantages noted above with respect to wooden and metal pallets. One notable disadvantage with prior art pallets made of plastics and fiber reinforced materials is their general lack of center load capabilities, especially when the pallets are used in rack storage wherein the pallets are supported along their peripheral sides with no support in the center of the pallet.

3. Objectives

A principal objective of the present invention is to provide an improved, one piece, lightweight, plastic pallet that has relatively strong unibody construction with increased center load capabilities, whereby the plastic pallet has rack storage capabilities, i.e., the pallet can be used in rack storage systems wherein the pallet is supported from the peripheral sides thereof. It is a further objective of the present invention to provide an improved pallet of the foregoing type that is nestable, is accessible from all sides by fork lift trucks and hand pallet trucks, is completely recyclable, and is readily and inexpensively manufactured from available plastic materials using thermo-vacuum forming and injection molding techniques.

SUMMARY OF THE INVENTION

The above objectives are achieved in accordance with the present invention by providing a plastic pallet which is thermoformed from a substantially planar sheet of plastic material. The pallet is preferably made of a recyclable plastic material. The sheet of plastic material is formed so as to include a goods-supporting or materials loading upper surface and a lower lift-engaging surface. Inasmuch as a single sheet of plastic material forms both surfaces, any recessed configuration present on one side will have a corresponding reverse configuration on the other. For example, a recess on the upper surface corresponds to a projection on the lower surface and vice versa. There is no limitation as to the peripheral shape of the pallet. However, the pallet will preferably be square or rectangular as is the custom in the industry.

The peripheral edges of the pallet are rolled downwardly to form a peripheral rolled flange extending downwardly away from the upper surface of the pallet. The rolled peripheral edges of the pallet provide a finished edge which enhances the safety and handling characteristics of the pallet. In addition, the rolled peripheral edges provide added structural strength to the edge of the pallet.

A peripherally extending rib is formed in the pallet. The peripheral rib is located adjacent to the peripheral rolled flange, running substantially parallel to the rolled flange. The peripheral rib is formed by an elongate, channel-like depression in the upper surface of the sheet of plastic material which, in turn, forms the corresponding elongate projection from the lower surface of the sheet of plastic material.

Eight load supporting legs are provided which are situated closely adjacent to the peripheral rolled flange and equally spaced from each other around the peripheral rolled flange. The legs are hollow and are formed by depressions in the upper surface of the sheet of plastic material, with corresponding projections from the lower surface of the sheet of plastic material. The legs project from the lower surface by a substantially greater distance than does the peripherally extending rib. The peripherally extending rib intersects with the eight legs so that the rib is intermittingly interrupted by the spaced legs, i.e., the peripherally extending rib extends in sections between peripherally adjacent legs.

A central load supporting leg is provided and situated at the central portion of the sheet of plastic material. The central leg is hollow and is formed by a depression in the upper surface of the sheet of plastic material, with the corresponding projection from the lower surface of the sheet of plastic material. The central leg projects from the lower surface by substantially the same distance as do the other eight legs which are positioned adjacent to the periphery of the sheet of plastic material.

A recessed receptacle or cavity is formed in the upper surface of the sheet of plastic material so as to project from the bottom surface of the sheet of plastic material, with the receptacle or cavity encircling the central load supporting leg. The receptacle or cavity has a depth which is less than the distance which the central leg projects from the lower surface of the sheet of plastic material, and the inner side of the receptacle or cavity opens to the central leg so that the receptacle or cavity forms a countersunk enlargement about the central leg.

A removable center plug or insert is provided to fit snugly within the countersunk receptacle or cavity and to encircle the central leg. The center plug or insert provides strength for the pallet to resist deflection of the central portion of the pallet when the pallet is rack supported, i.e., when the pallets are supported along their peripheral sides with no support in the center of the pallet. The center plug or insert is removable if so desired.

A plurality of radially extending, elongate rib depressions are formed in the upper surface of the sheet of plastic material. The rib depressions originate at the countersunk receptacle or cavity and extend radially outwardly therefrom. The radially extending ribs terminate in respective load supporting legs adjacent to the perimeter of the sheet of plastic material. Mutually respective inner ends of the radially extending ribs are open to the countersunk receptacle or cavity, with the outer ends of the radially extending ribs being open to the respective load supporting legs. The radially extending ribs are channel-like in shape similar to the peripheral rib, and the radially extending ribs form corresponding elongate projections from the lower surface of the sheet of plastic material. The radially extending ribs project from the lower surface by substantially the same distance as does the peripheral extending rib, i.e., the depths of the peripheral rib and the radially extending ribs are substantially equivalent.

Additional objects, features and advantages of the present invention will become apparent from a consideration of the following detailed description presented in connection with the accompanying drawings.

BRIEF DESCRIPTION OF THE DRAWINGS

A pallet, which illustrates preferred embodiments in accordance with the present invention and which incorporates the best mode presently contemplated of carrying out the invention, is in the drawings, in which.

DESCRIPTION OF THE PREFERRED EMBODIMENTS

Figure 1:
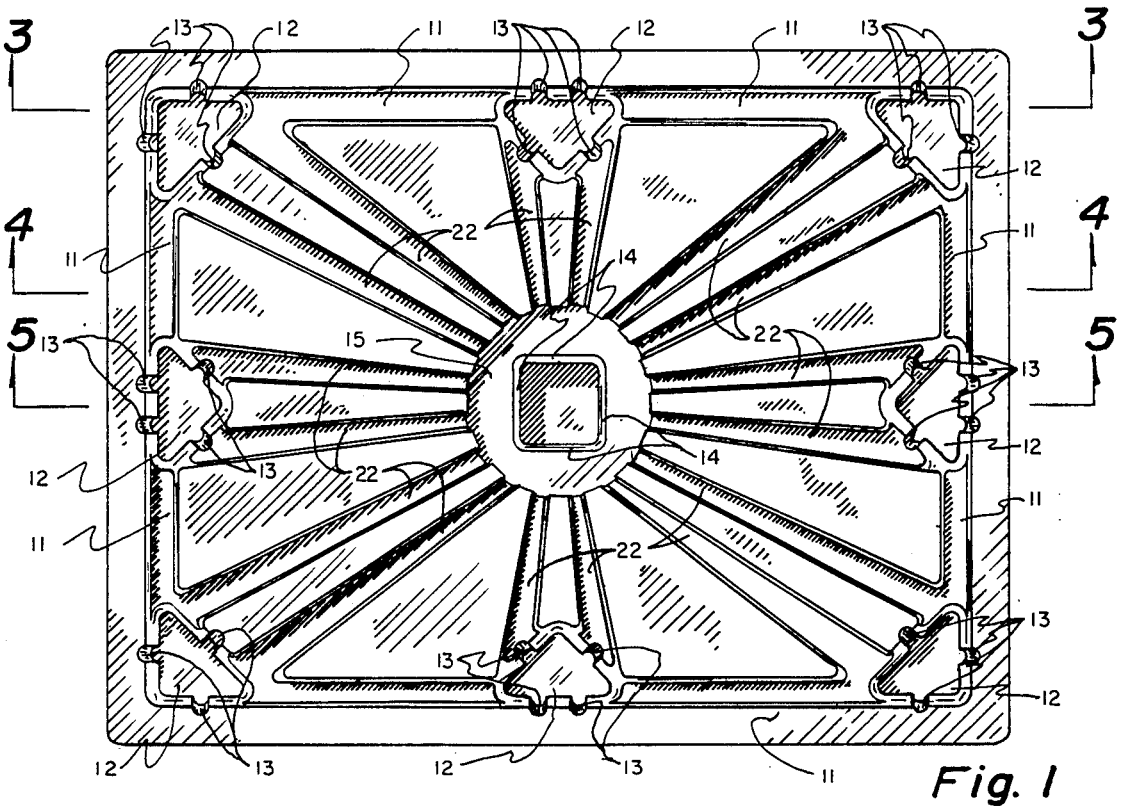
Fig. 1 is a top, plan view of a pallet in accordance with the present invention.
Figure 2:
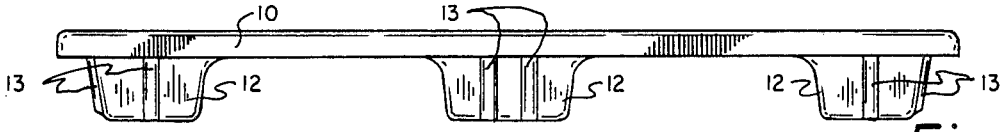
Fig. 2 a side elevation view of the pallet of Fig.
Figure 3:
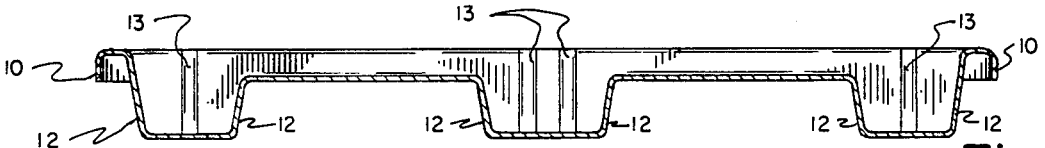
Fig. 3, 4 and 5 are vertical cross-section views taken respectively along lines 3—3, 4—4 and 5—5 of FIG. 1.
Figure 4:
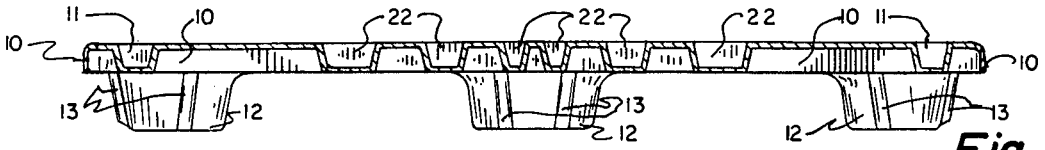

In accordance with the present invention there is provided a novel, unique plastic pallet which is of an improved, lightweight construction. In particular, an improved pallet is provided that has a strong generally unibody construction, with the pallet further comprising a completely novel construction at its central portion which provides exceptional strength and load bearing characteristics even when the pallet is used in rack storage fashion, i.e., when the loaded pallet is supported from the peripheral sides thereof with no support in the central portion of the pallet.

The load bearing surface and the legs of the pallet of the present invention are of generally unibody construction, with the pallet being thermoformed from a thermoplastic material such as polyethylene, polypropylene, nylon, acrylic, acrylonitrile-butadiene, ABS polymers, methyl methacrylate, copolymers of acrylics and methacrylate esters, polyesters, polyvinyl chlorides, polycarbonates, high impact polystyrene, and others as is well known in the thermoforming art. The sheet of thermoplastic material is thermoformed such that the upper surface of the sheet of material defines a goods-supporting surface. A plurality of recesses are formed in the sheet, with any recessed configurations formed on the upper surface having a corresponding reverse configuration on the lower surface. The pallet can have opposed sides and edges as, for example, where the pallet is square or is rectangular in shape. However, the pallet can also be circular, ellipsoidal or irregular in shape.

As is shown in the accompanying drawings, the pallet is formed with a peripheral flange 10 which is formed by drawing the edges of the sheet of material downwardly. The peripheral flange 10 is preferably joined to the upper surface of the pallet through a generally rolled radius rather than having a sharp, squared edge. The peripheral flange 10 extends generally normally to the plane of the upper surface of the pallet and around the entire periphery of the pallet. The flange 10 has two main functions. It, of course, strengthens the pallet, and it provides a peripheral lip by which the pallet can be rack supported.

A peripheral, depressed channel or rib 11 (the peripheral depression has the shape of a channel when viewed from the top surface of the pallet and the shape of a rib when viewed from the lower surface of the pallet) is formed in the pallet. The rib or channel 11 is situated proximately to the peripheral flange 10. Preferably, the rib or channel 11 extends generally parallel to the respective flange 10 and the longitudinal center axis of the rib or channel 11 is spaced from the flange 10 by about 2 to 3.5 inches. The sides of the rib or channel 11 preferably taper towards each other in the direction away from the upper surface of the pallet, with the rib or channel 11 having a cross-sectional width of between about 1.25 and 2.5 inches at the upper surface of the pallet. The rib or channel 11 has a generally flat lowermost wall which is substantially parallel with the upper surface of the pallet, with the width of the lowermost wall being between about 1 inch and 2 inches. The sides of the ribs or channel 11 preferably join the lowermost wall in a radius rather than in a sharp edge. The rib or channel 11 may extend continuously around the periphery of the pallet, or it can be segmented as shown in the drawings, with the opposite ends of the segments of the rib or channel 11 communicating with and opening into mutually respective depressions which form the supporting legs 12.

As illustrated, the pallet preferably is of a square or rectangular shape and has eight load supporting legs 12 which are positioned closely adjacent to the periphery of the pallet. The legs 12 are spaced around the periphery of the pallet with four of the legs being positioned at or adjacent to mutually respective corners of the pallet, and with the four remaining legs being positioned equidistantly between the corners of the pallet. The legs 12 are formed by depressions in the upper surface of the sheet of material forming the pallet, with corresponding projections from the lower surface of the sheet of material. The legs 12 project from the lower surface by a substantially greater distance than the depth of the rib or channel 11. Preferably, the rib or channel projects to a depth of about 1 to 2 inches, and the legs 12 project from about 4 to 6 inches from the surface of the pallet.

The legs 17 are generally triangular in shape along sections taken through the legs 12 on planes which are parallel with the surface of the pallet. The triangular cross section of the legs 12 is preferably that of an isosceles right triangle. The sides of the legs 12 preferably join in a radius instead of a sharp edge, and the bottom wall of each leg 12 is substantially parallel to the upper surface of the pallet. The bottom walls preferably join the side walls of the legs 12 in a radius instead of a sharp edge. The corner legs are oriented such that the right angle of the triangular shaped legs is positioned adjacent to the corner of the pallet, with the side walls of the legs 12 which form the legs of the cross-sectional, isosceles triangle extending from the respective corners of the pallet along the sides of the pallet. The four legs which are positioned along the respective sides of the pallet between the corners of the pallet are oriented such that the triangular cross sections of each leg has the right triangle thereof being directed toward the center of the pallet, with the hypotenuse of the triangular cross section being positioned adjacent to and parallel with the mutually respective side of the pallet. Reinforcing ribs 13 can be molded into the legs 12 to provide increased strength. The reinforcing ribs 13 are preferably formed in the side walls of each of the legs 12, with the reinforcing ribs extending substantially the full depth of the legs 12 in a direction substantially perpendicular to the upper surface of the pallet. As illustrated, the side walls of the corner legs each have one reinforcing rib 13 disposed centrally of the respective side wall. The other four legs have a single reinforcing rib 13 in the side walls thereof which are directed inwardly of the pallet, with the sidewalls which are parallel the perimeter of the pallet having two equally spaced reinforcing ribs formed in each respective side wall. The reinforcing ribs 13, as illustrated, are preferably semicircular in cross section.

A center load supporting leg 14 is provided and situated substantially at the center of the sheet of plastic material forming the upper surface of the pallet. The center leg 14 is formed by a depression in the upper surface of the sheet of thermoplastic material, with a corresponding projection from the lower surface of the sheet of thermoplastic material. The center leg 14 projects from the lower surface by substantially the same distance as do the other eight legs 12 which are positioned adjacent to the periphery of the sheet of thermoplastic material. As illustrated, the center leg 14 is formed by four projecting side walls such that the cross section of the leg has the general form of a square or rectangle. The center leg 14 could, of course, have other shapes. For example, it could be triangular as the other eight legs or it could be arcuate such that the cross-sectional shape is circular, ellipsoidal or other arcuate shape. Although not shown, the side walls of the center leg 14 could be provided with reinforcing ribs similar to the reinforcing ribs 13 of the other eight legs 12. When the center leg comprises planar side walls as illustrated, the respective side walls are joined along their intersecting side edges in a radius instead of a sharp edge, and the bottom wall of the center leg 14 is substantially parallel to the upper surface of the pallet. The bottom wall preferably joins the side walls of the leg 14 in a radius instead of a sharp edge.

A recessed receptacle or cavity 15 is formed in the upper surface of the sheet of thermoplastic material, with the receptacle or cavity 15 encircling the center load supporting leg 14. The receptacle or cavity 15 has a depth which is less than the distance which the center leg 14 projects from the lower surface of the sheet of plastic material. Preferably, the depth of the receptacle or cavity 15 will be between about 1 inch and 2 inches. The inner side of the receptacle or cavity 15 opens to the center leg 14 such that the receptacle or cavity forms a countersunk enlargement about the center leg 14.

Figure 5:
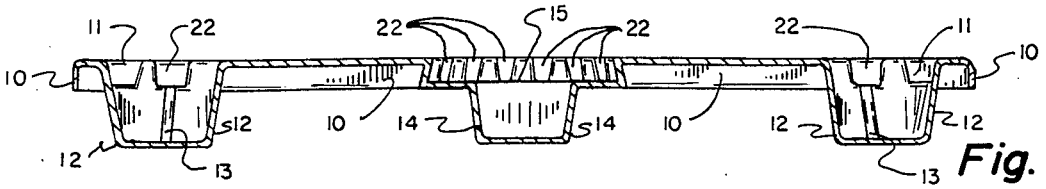
Figure 6:
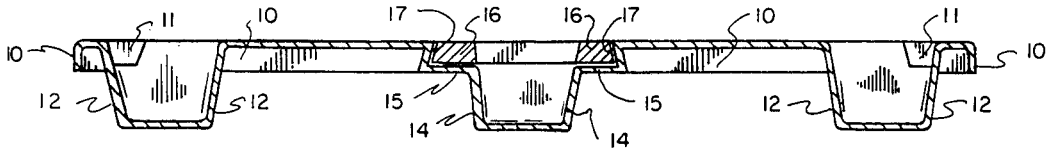
FIG. 6 is a view similar to that of FIG. 5 with the exception that a removable center plug is shown positioned within the receptacle or cavity forming the countersunk enlargement about the center leg of the pallet.

The receptacle or cavity 15 is preferably arcuate or round in shape as illustrated. However, the receptacle could be square or multisided. As the number of sides of a multisided cavity increases, the shape of the cavity would, of course, approach the circular-shaped cavity 15 as illustrated. The perimeter side wall of the receptacle or cavity 15 is preferably undercut, i.e., it slopes toward the perimeter of the pallet as the side wall extends downwardly from the upper surface of the pallet. This is best shown in FIGS. 5 and 6 of the drawings. The purpose of the outwardly sloped perimeter of the receptacle or cavity 15 will be discussed hereinafter.

A removable insert or center plug 16 is provided to fit snugly within the countersunk receptacle or cavity 15 and to at least encircle the recession which forms the center leg 14. The center plug 16 is shaped so as to fit snug1y within the countersunk receptacle or cavity 15. The center plug 16 has a thickness which is essentially the same as the depth of the receptacle or cavity 15, such that when the center plug 16 is in place in the receptacle or cavity 15, the upper surface of the center plug 16 will be essentially coplanar with the upper surface of the pallet. As illustrated, the plug 16 is disc shaped, having a circular diameter which matches the diameter of the receptacle or cavity 15. As shown in FIGS. 6–9 of the drawings, the perimeter wall 17 of the center plug 16 is preferably sloped or slanted radially outwardly in a direction from the top surface of the center plug 16 to the lowermost surface thereof. The slope in the perimeter wall 17 of the center plug 16 is of the same degree as the slope in the sloped perimeter of the receptacle or cavity 15 in the upper surface of the pallet. This allows the center plug to snap into the receptacle or cavity 15 and be securely held in place therewithin. To assist in placing the center plug 16 within the receptacle or cavity 15, the underside of the center leg 14 can be pushed upwardly to flex the upper surface of the pallet upwardly. This tends to open the receptacle or cavity 15 such that the center plug 16 can be forced therewithin without requiring special equipment. Once received within the receptacle or cavity 15, the center plug 16 is retained securely therewithin, with the sidewall of the receptacle or cavity 15 making compressive contact with the perimeter wall 17 of the center plug 16. A space is shown between the perimeter of the receptacle or cavity 15 and the perimeter wall 17 of the center plug 16 in FIG. 6 for purposes of illustration only. In actual practice, the perimeter of the receptacle or cavity 15 would be in tight compressive engagement with the perimeter wall 17 of the center plug 16. The center plug 16 can be removed if so desired by again flexing the surface of the pallet around the center plug 16 upwardly and forcing the center plug out of engagement with the receptacle or cavity 15.

Figure 7:
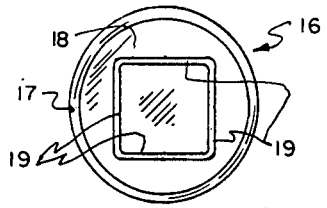
FIG. 7 is a top, plan view of a center plug which is adapted to be received in the receptacle or cavity as shown in FIG. 6.
Figure 8:
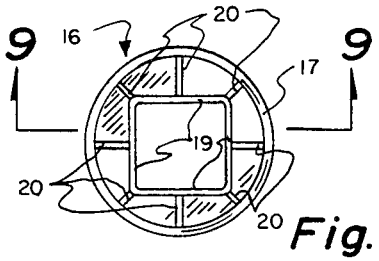
FIG. 8 is a bottom, plan view of the center plug of FIG. 7.
Figure 9:
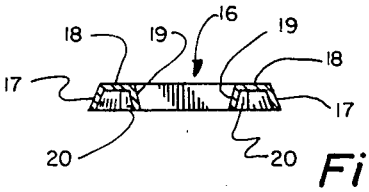
FIG. 9 is a vertical, cross-sectional view taken along line 9—9 of FIG. 8.

The center plug 16 can be made of a solid piece of material such as wood, metal or polymeric plastic material. A solid metal plug is rather heavy and costly. A solid wood plug or polymeric plastic is less costly and, of course, lighter in weight than a solid metal plug. It has been found advantageous to make the center plug 16 in the form of a hollow member from a thermoplastic material similar to the material from which the pallet itself is made. As shown in FIGS. 8 and 9, the center plug can be formed of an upper plate 18 (FIGS. 7 and 9), with the perimeter wall 17 molded integrally thereto. An inner opening is preferably provided in the plug 16 for purposes which will be described hereinafter. In the hollow form of the plug 16, inner support walls 19 extend downwardly from the inner opening in the plug 16. The inner support walls 19 provide strength and integrity to the plug 16. Further strength can be provided to the plug 16 by providing a plurality of radially extending support ribs 20 which extend between and are molded integrally to the inner support walls 19 and the perimeter wall 17 of the plug 16.

The center plug 16 provides exceptional strength for the pallet when combined with radially extending elongate ribs 22 which, as will be described hereinafter, are formed in the surface of the pallet. The center plug 16 provides strength for the pallet to resist collapse of the central portion of the pallet, especially when the pallet is rack supported, i.e., when the pallet is supported along its peripheral sides with no support in the center of the pallet.

The radially extending elongate ribs 22 are formed in the upper surface of the sheet of thermoplastic material from which the pallet is made. The rib depressions 22 originate at the countersunk receptacle or cavity 15 and extend outwardly therefrom in a generally radially fashion. The ribs 22 terminate in respective load supporting legs 12 adjacent to the perimeter of the pallet. The inner ends of the ribs 22 are open to the countersunk receptacle or cavity 15, with the outer ends of the ribs 22 being open to the respective load supporting legs 12. The ribs 22 are channel-like in shape somewhat similar to the peripheral rib or channel 11, and the ribs 22, of course, form corresponding elongate projections from the lower surface of the sheet of thermoplastic material from which the pallet is made.

The ribs 22 project from the lower surface of the sheet of thermoplastic material by substantially the same distance as the depth of the receptacle or cavity 15, i.e., the depth of the ribs 22 is essentially the same as the depth of the receptacle or cavity 15. Preferably, the depth of the peripheral rib or channel 11, and the depths of the ribs 22 and the receptacle or cavity 15 is essentially the same. Each of the ribs 22 is formed from two opposite elongate side walls which extend downwardly from the sheet of thermoplastic material. At the outer end of each rib 22, the respective side walls are separated by a distance of from about 1.25 to 2.25 inches. The mutually respective side walls taper toward each other in the direction toward the center of the pallet, so that at the inner end of each rib 22, the resepctive side walls are separated by a distance of from about 0.5 inch to 1.25 inches. In addition to tapering along their longitudinal length, the opposite side walls of each rib 22 also tapers inwardly in a direction of their width, such that the channel formed by the ribs 22 has a greater width at the surface of the pallet than at the bottom of the channel. The side walls of the ribs 22 are preferably joined integrally to the surface of the pallet in a radius rather than a sharp edge, and the bottom walls of the ribs 22 are preferably joined to their respective side walls in a radius rather than a sharp edge.

The open ends of the channels formed by the ribs 22 at the central portion of the pallet are preferably equally spaced around the perimeter of the receptacle or cavity 15. Because the open ends of the ribs 22 are equally spaced around the cavity 15, the ribs 22 do not extend in a true radial line from the center of the pallet. However, the ribs are very close to being disposed radially, and the term "radially extending" as used throughout this application is meant to include any arrangement of the ribs 22 in which the ribs extend from the receptacle or cavity 15 toward the perimeter of the pallet. As shown, the ribs 22 are arranged in pairs. One pair of ribs 22 extend to each of the eight load supporting legs 12 at the perimeter of the pallet. Each pair of ribs 22 are spaced from each other such that they have a maximum separation at their ends which open into the depression forming the mutually respective legs 12. An alternative, less preferred arrangement of the ribs 22 can be used which is somewhat similar to the arrangement of ribs in the pallet shown in U.S. Pat. No. 3,707,127. In the less preferred embodiment, a single rib could extend from the receptacle or cavity 15 to each of mutually respective load supporting legs 12. Intermediate ribs would then extend between the receptacle or cavity 15 to the peripheral rib or channel 11 at points intermediate the legs 12. Of course, instead of using matched pairs of ribs 22 as illustrated in the accompanying drawings, a sing1e rib could be used extending from the receptacle or cavity 15.

The pallets are adapted to be nested together to minimize storage space for the unused pallets. For this purpose, the legs 12 and the center leg 14 are tapered so as to gradually decrease in overall size toward the bottoms of the legs. This allows the bottoms of the legs to be received within the open upper ends of mutually corresponding legs when the pallets are stacked upon each other so as to nest together. If the center plug 16 is formed without a central opening therein, it can be realized that the central plug 16 would have to be removed from the pallets in order for the pallets to be stacked upon each other so as to nest together. It has been found that such an arrangement is workable, and the present invention is indeed intended to encompass the use of a center plug 16 which has no central opening therein.

However, in a preferred embodiment of the invention it has been found highly desirable to provide a central opening in the center plug 16. With the central opening, the pallets can be stacked upon themselves in nesting relationship without the removal of the central plug. As shown in FIGS. 6–9 of the drawings, the central opening in the center plug 16 is formed such that the perimeter of the central opening aligns with the perimeter of the depression forming the center leg 14 of the pallet. The walls forming the inner perimeter of the central opening in the center plug is advantageously tapered such that their tapers align with the tapers of the mutually respective sides of the depression forming the center leg 14. It has been found, rather unexpectedly, that center plugs with the central openings therein as described above provide almost as much strength to the pallet as a center plug having no central opening therein, and the provision of the central openings are highly desirable as also explained above.

The plastic pallets of the present invention, comprising the combination of radially extending ribs 22, a central receptacle or cavity 15 and a center plug member 16 adapted to be received within the central receptacle or cavity 15, have been found to be exceptionally strong and capable of sustaining high loading even when the pallets are supported from the peripheral sides thereof with no center support. Load testing of the plastic pallets of the present invention indicates exceptional loading capabilities. Sample pallets were made from sheets of a thermoplastic material, with the sheets having a thickness of either ¼ or ⅜ inch. The sample pallets were made by thermoforming equipment in which the sheets of plastic were heated and then pressure or vacuum drawn over a mold to form the various ribs, legs and center receptacle or cavity of the pallet in accordance with the present invention. Center plugs 16 were formed by molding a thermoplastic material into a generally hollow plug having reinforcing ribs 20, on peripheral wall 17, a top wall 18 and inner walls 19 which formed an inner opening in the center plug 16, all as shown in FIGS. 7–9 of the drawings.

Sample pallets having external, overall dimensions of 36 inches by 48 inches and 42 inches by 48 inches were formed from sheets of material of both ⅜ and ¼ inch thickness. Sample pallets made from ⅜ inch thickness sheets in the 36 by 48 inches dimension and the 42 by 48 inches dimension will be referred to hereinafter by the designations "Pallets A" and "Pallets B," respectively. Sample pallets made from ¼ inch thickness sheets in the 36 by 48 inches dimension and the 42 by 48 inches dimension will be referred to hereinafter by the designations "Pallets C" and "Pallets D," respectively.

The test pallets were subjected to loading tests in which the loads were distributed equally over the surface of the pallets. The pallets were supported in a rack storage type arrangement, i.e., the pallets were supported from their feet at the perimeters of opposite sides of the pallets rather than uniformly by all of their feet. The results of the loading tests are shown in the following Table I. The term "length support" as used in Table I refers to the pallet being supported from the opposite longer sides thereof, and the term "width support" refers to the pallet being supported from the opposite shorter sides thereof.

TABLE I

| | Load Capability Length Support | Load Capability Width Support |
|---|---|---|
| Pallet A | 5262 pounds | 3438 pounds |
| Pallet B | 4153 pounds | 3438 pounds |
| Pallet C | 3393 pounds | 2217 pounds |
| Pallet D | 2678 pounds | 2217 pounds |

The load capabilities were based, on a limited yield stress of 3500 psi with a factor of safety of 2.0, pallet bending. The load capabilities as reported above greatly surpass the safe loading of plastic pallets of the prior art which do not have the center plug configuration of the present invention.

In a second set of loading tests, the pallets, still identified as above, were tested with the loads being distributed so as to concentrate at the center of the pallet rather than equally over the surface of the pallet. The pallets were supported from their opposite sides in rack storage type arrangement as in the previously mentioned tests. The results of the latter tests are shown in the following Table II. The term "length support" as used in Table II refers to the pallet being supported from the opposite longer sides thereof, and the term "width support" refers to the pallet being supported from the opposite shorter sides thereof.

TABLE II

| | Load Capability Length Support | Load Capability Width Support |
|---|---|---|
| Pallet A | 2012 pounds | 1450 pounds |
| Pallet B | 1692 pounds | 1450 pounds |
| Pallet C | 1297 pounds | 935 pounds |
| Pallet D | 1091 pounds | 935 pounds |

The load capabilities were based on the same criteria as stated in the previous mentioned tests. Again the load capabilities as reported above greatly surpass the safe loading of plastic pallets of the prior art which do not have the center plug configuration of the present invention.

The center plug configuration in combination with the other features of the pallet of the present invention is responsible for the exceptional load bearing characteristics of the pallet of the present invention.

Preferably, the pallets of the present invention are made from flat thermoplastic sheets which have a thickness of from about ⅛ inch to ⅜ inch. Commercial thermoforming equipment can be used to form the sheets by heating the sheets and then pressure or vacuum drawing the heated sheets over a mold to integrally form the various ribs, legs, and flanges and center receptacle or cavity of the pallet in accordance with the present invention. The center plug is formed by commercially available molding or stamping or cutting equipment, depending upon the composition of the material from which the center plug is made.

Although particularly preferred embodiments of the apparatus of the present invention have been illustrated and described, it is to be understood that the present disclosure is made by way of example and that various other embodiments are possible without departing from the subject matter coming within the scope of the following claims, which subject matter is regarded as the invention.

We claim:

1. In a pallet of the type comprising a sheet of generally rigid material having a top surface for supporting a load and a bottom surface which serves as a lift-engaging surface, and wherein the pallet further comprises a peripherally extending rib projecting from the bottom surface, a plurality of substantially radially extending ribs projecting from the bottom surface and oriented so as to extend from the central portion of the pallet outwardly toward the periphery of the pallet, a plurality of hollow legs projecting from the bottom surface so as to form open depressions in the top surface, with the hollow legs further being positioned around the periphery of the sheet of rigid material, and a central hollow leg projecting from the bottom surface so as to form an open central depression in the top surface, with the central hollow leg being positioned at the central portion of the sheet of rigid material, the improvement comprising a recessed receptacle or cavity formed in the upper surface of the sheet of material so as to encircle the open central depression which forms the central hollow leg, said receptacle or cavity having a depth which is less than the distance which the central leg projects from the bottom surface of the sheet of plastic material, with the inner side of the receptacle or cavity opening to the hollow depression forming the hollow central leg whereby the receptacle or cavity forms a countersunk enlargement about the hollow central leg, and a center plug or insert which has a central opening therethrough, with the central opening being of substantially the same size and shape as the open central depression of the central hollow leg, said center plug or insert further being adapted to fit snugly within the countersunk receptacle or cavity whereby the center plug provides strength for the pallet to resist deflection of the central portion of the pallet when the pallet is supported along the peripheral sides thereof with no support in the central portion of the pallet.

2. The improvement in a pallet in accordance with claim 1, wherein a flange is provided around the periphery of the pallet, said flange extending downwardly from the upper surface of the pallet.

3. The improvement in a pallet in accordance with claim 1, wherein the center plug or insert is removable from the countersunk receptacle or cavity.

4. The improvement in a pallet in accordance with claim 1, wherein the radially extending ribs are generally channel-shaped in cross section, the radially extending ribs originate at the countersunk receptacle or cavity, and the mutually respective inner ends of the radially extending ribs are open to the countersunk receptacle or cavity.

5. The improvement in a pallet in accordance with claim 1, wherein the countersunk receptacle or cavity has an arcuate or circular shaped perimeter, and the center plug or insert is essentially disc shaped having an arcuate or circular perimeter of the same shape and size as the perimeter of the countersunk receptacle or cavity.

6. The improvement in a pallet in accordance with claim 5, wherein the perimeter side wall of the countersunk receptacle or cavity is tapered outwardly from the central portion of the pallet such that the diameter of the countersunk receptacle or cavity is larger at the inside or countersunk face of the countersunk receptacle or cavity than at the opening of the countersunk receptacle or cavity at the top surface of the pallet, and the perimeter side wall of the center plug or insert is tapered outwardly so as to interengage the tapered side wall of the countersunk receptacle or cavity when the center plug or insert is received within the countersunk receptacle or cavity, whereby the center plug or insert is securely held within the countersunk receptacle or cavity.

7. The improvement in a pallet in accordance with claim 1, wherein the center plug or insert has a thickness which is essentially the same as the depth of the countersunk receptacle or cavity such that when the center plug or insert is received within the countersunk receptacle or cavity, the upper surface of the center plug or insert is substantially coplanar with the top surface of the sheet of material forming the pallet.

* * * * *